US006676100B2

(12) United States Patent
Hsu

(10) Patent No.: US 6,676,100 B2
(45) Date of Patent: Jan. 13, 2004

(54) NOTE HOLDER

(75) Inventor: Nick Hsu, Taichung (TW)

(73) Assignee: Synchro Ent., Co., Ltd., Taichung (TW)

( * ) Notice: Subject to any disclaimer, the term of this patent is extended or adjusted under 35 U.S.C. 154(b) by 0 days.

(21) Appl. No.: 10/263,634

(22) Filed: Oct. 3, 2002

(65) Prior Publication Data

US 2003/0168568 A1 Sep. 11, 2003

(30) Foreign Application Priority Data

Mar. 6, 2002 (TW) ..... 91202552 U

(51) Int. Cl.[7] ..... A47B 97/04

(52) U.S. Cl. ..... 248/452; 248/441.1; 248/451; 248/473; 248/474; 40/358; 40/642.02; 40/649

(58) Field of Search ..... 248/451, 452, 248/453, 447, 441.1, 473, 474; D19/90; 40/358, 649, 642.02

(56) References Cited

U.S. PATENT DOCUMENTS 1,840,783 A * 1/1932 McCarthy ..... 211/11
3,779,504 A * 12/1973 Schwartz et al. ..... 248/441.1
3,954,246 A * 5/1976 Sparkman ..... 248/453
4,483,505 A * 11/1984 Dalbo ..... 248/447
4,943,024 A * 7/1990 Meyer ..... 248/316.7
4,957,261 A * 9/1990 Cirami ..... 248/454
5,667,183 A * 9/1997 Hiromori ..... 248/451
5,697,594 A * 12/1997 Adams et al. ..... 248/442.2
5,845,889 A * 12/1998 Suzuki ..... 248/451
5,890,603 A * 4/1999 Arguin et al. ..... 211/45
D413,928 S * 9/1999 Cianci ..... D19/86
D419,602 S * 1/2000 Mori ..... D19/91
D426,853 S * 6/2000 Clubbe ..... D19/90
6,267,346 B1 * 7/2001 Dill et al. ..... 248/473
D448,418 S * 9/2001 Langenbach ..... D19/90
D451,962 S * 12/2001 Thornton ..... D19/78
6,367,761 B1 * 4/2002 Suzuki ..... 248/451
D466,556 S * 12/2002 Rosado ..... D19/90
D468,359 S * 1/2003 Chen ..... D19/65
6,502,792 B1 * 1/2003 Cho et al. ..... 248/121

* cited by examiner

*Primary Examiner*—Ramon O. Ramirez
*Assistant Examiner*—Amy J. Sterling
(74) *Attorney, Agent, or Firm*—Alan D. Kamrath; Rider Bennett, LLP

(57) ABSTRACT

A note holder for holding a notepaper, card, etc. The note holder has a foldable capability and includes a body pivotally mounted in a base. The base has an inner space for receiving the body when the note holder is folded. A slot adapted to hold a piece of paper is defined in the body and several fins are formed in the slot on the body. The fins hold the paper that is inserted in the slot in position.

16 Claims, 5 Drawing Sheets

NOTE HOLDER

BACKGROUND OF THE INVENTION

1. Field of the Invention

The present invention relates to a note holder, and more particularly to a note holder that can hold a note firmly in place and can be completely folded to save storage space; making it easy to carry.

2. Description of Related Art

A note holder is used to hold a piece of paper such as a note or a business card to notify or remind someone about something. With reference to FIG. 5, a conventional note holder includes a body (40) with a top surface (not numbered). An inclined slot (41) has two curved surfaces facing each other. The slot (41) is adapted to hold a note (30) and is defined in the top surface of the body (40).

However, the conventional note holder has the following shortcomings:

1. Inconvenient to use:

The slot (41) is a simple structure and only holds the note (30) at the angle of the slot (41). The note (30) in the slot (41) cannot be held securely in the slot (41). A large piece of paper may slide to one side of the slot (41) or bend in half when it is in the slot (41). So the conventional note holder can be used to hold small pieces of paper only.

2. Occupies excessive space when not in use:

The body (40) is solid and occupies a specific space at all times. When the note holder is not in use, the same space is required as when it is in use. Furthermore, the volume is inconvenient for carrying it.

To overcome the shortcomings, the present invention tends to provide an improved note holder assembly to mitigate the aforementioned problems.

SUMMARY OF THE INVENTION

The main objective of the invention is to provide a foldable note holder so the note holder can save space when it is not in use and be carried easily.

The other objective of the invention is to provide an improved note holder that can hold and position a piece of paper well.

Other objectives, advantages and novel features of the invention will become more apparent from the following detailed description when taken in conjunction with the accompanying drawings.

DETAILED DESCRIPTION OF PREFERRED EMBODIMENT

Figure 1:
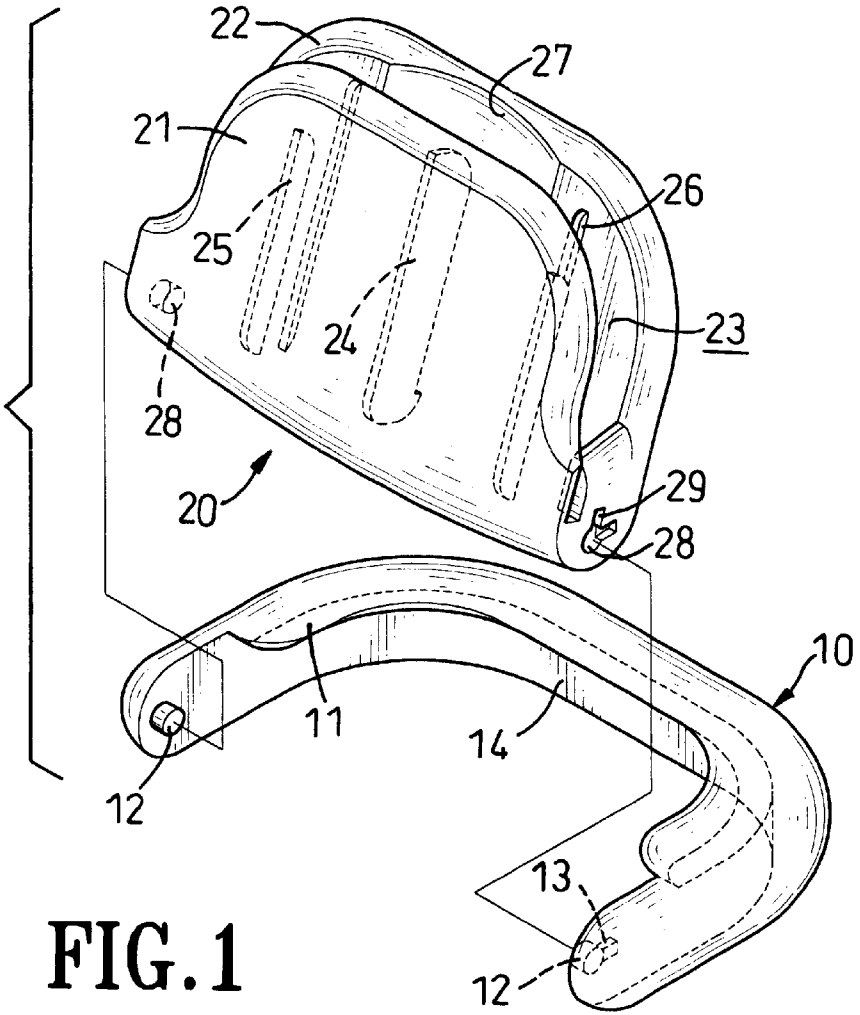
FIG. 1 is an exploded, perspective view showing a note holder in accordance with present invention.
Figure 2:
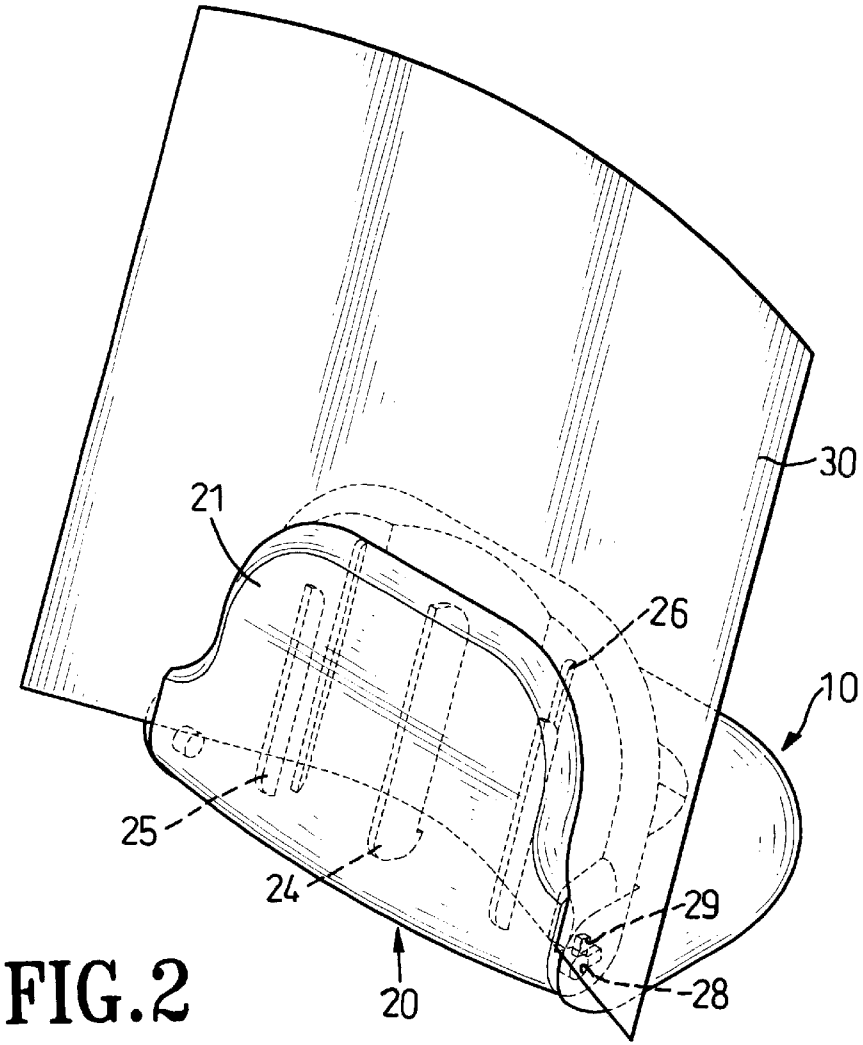
FIG. 2 is a perspective view of the note holder in FIG. 1 with a note.

With reference to FIGS. 1 and 2, a note holder in accordance with the present invention includes a U-shaped base (10) and a body (20). The base (10) has two ends (not numbered), a top, a bottom and an inside surface (14). The inside surface (14) is around an inner space (not numbered). A lip (11) is formed at the top of the base (10) and extending inward from the inside surface (14) except for a section near each end of the base (10). Two pivot pins (12) are formed on the inside surface (14) near the ends of the base (10) respectively. A key (13) is formed on and extending from one of the two pivot pins (12) toward the lip (11).

The body (20) is pivotally mounted on the base (10) and is received in the inner space of the base (10) when the note holder is closed. The body (20) has a center and includes a first wing (21) and a second wing (22). Both the first wing (21) and the second wing (22) have an inside surface facing each other. A slot (23) is formed between the first wing (21) and the second wing (22).

A primary fin (24) with two sides is formed in the center of the body (20) and two auxiliary fins (25) are formed parallel respectively on opposite sides of the primary fin (24) on the inside surface of the first wing (21). Two opposing fins (26) are formed respectively between the primary fin (24) and the auxiliary fins (25), and a recess (27) is defined between the two opposing fins (26) on the inside surface of the second wing (22).

Two pivot holes (28) are defined respectively in opposite sides of the body (20) corresponding to the pivot pins (12) in the base (10). Two keyholes (29) are defined at one side of the body (20) and communicate with the corresponding pivot hole (28). Each keyhole (29) corresponds to the key (13) with the body (20) in a specific position. The pivot pins (12) pivotally mount in the pivot holes (28), and the key (13) locks into one of the keyholes (29) at the same time.

Figure 3:
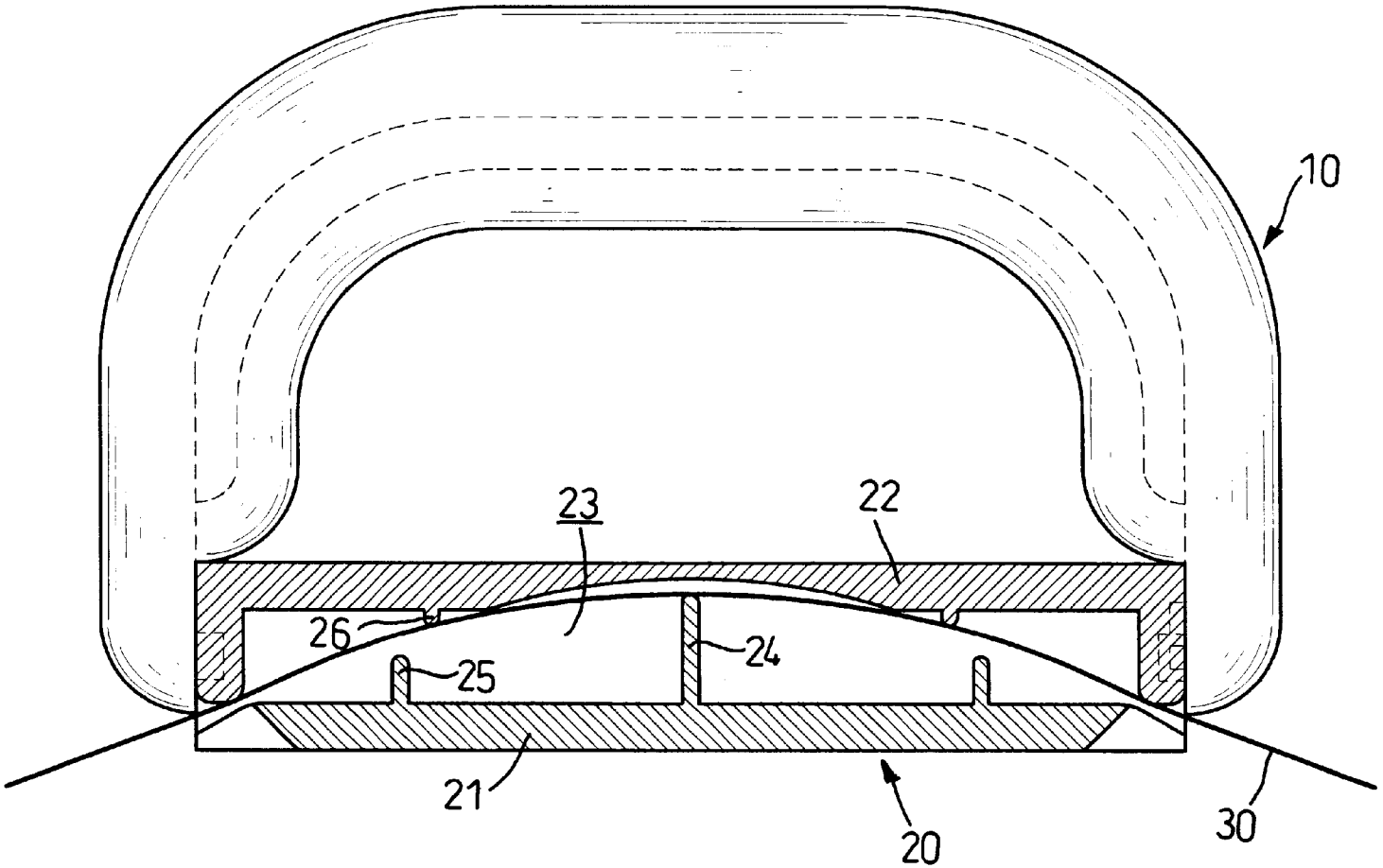
FIG. 3 is a cross sectional top plan view of the note holder in FIG. 1 with a note.

With reference to FIGS. 2 and 3, the body (20) is turned relative to the base (10) until the body (20) abuts the lip (11) of the base (10). The key (13) is fitted into one of the keyholes (29) so the body (20) is supported by the base (10) and can stand on a table. Thus, a note (30) such as a notepaper can be held in the slot (23) of the body (20) to display a message or the like. When the note (30) is inserted into the slot (23), the auxiliary fins (25) and the opposing fins (26) hold the note (30) and co-operate with the primary fin (24) to hold the note (30) firmly in place. Consequently, the note (30) will be positioned well, even when the wind is blowing.

Figure 4:
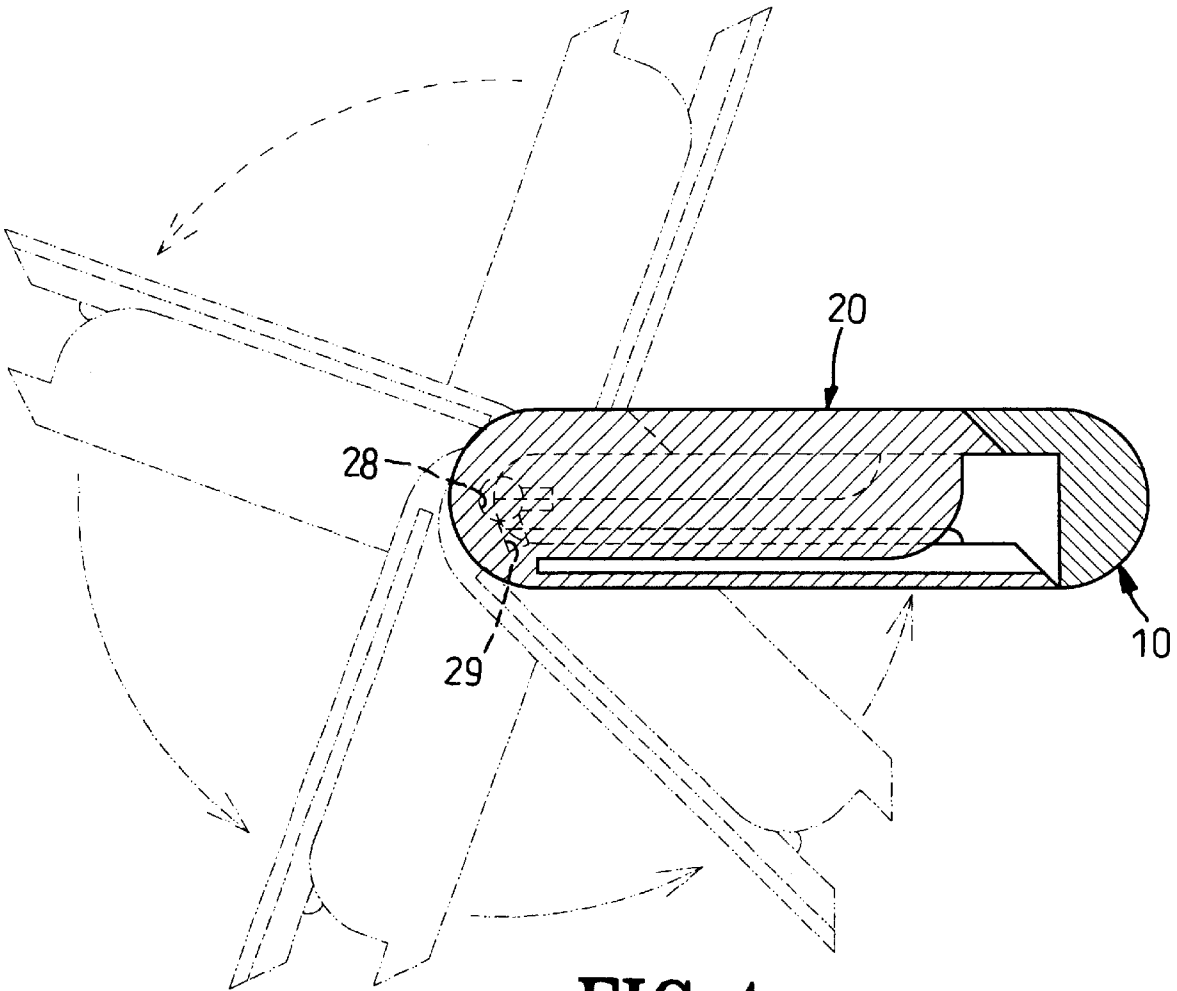
FIG. 4 is an operational cross sectional side plane view of the note holder in FIG. 1.
Figure 5:
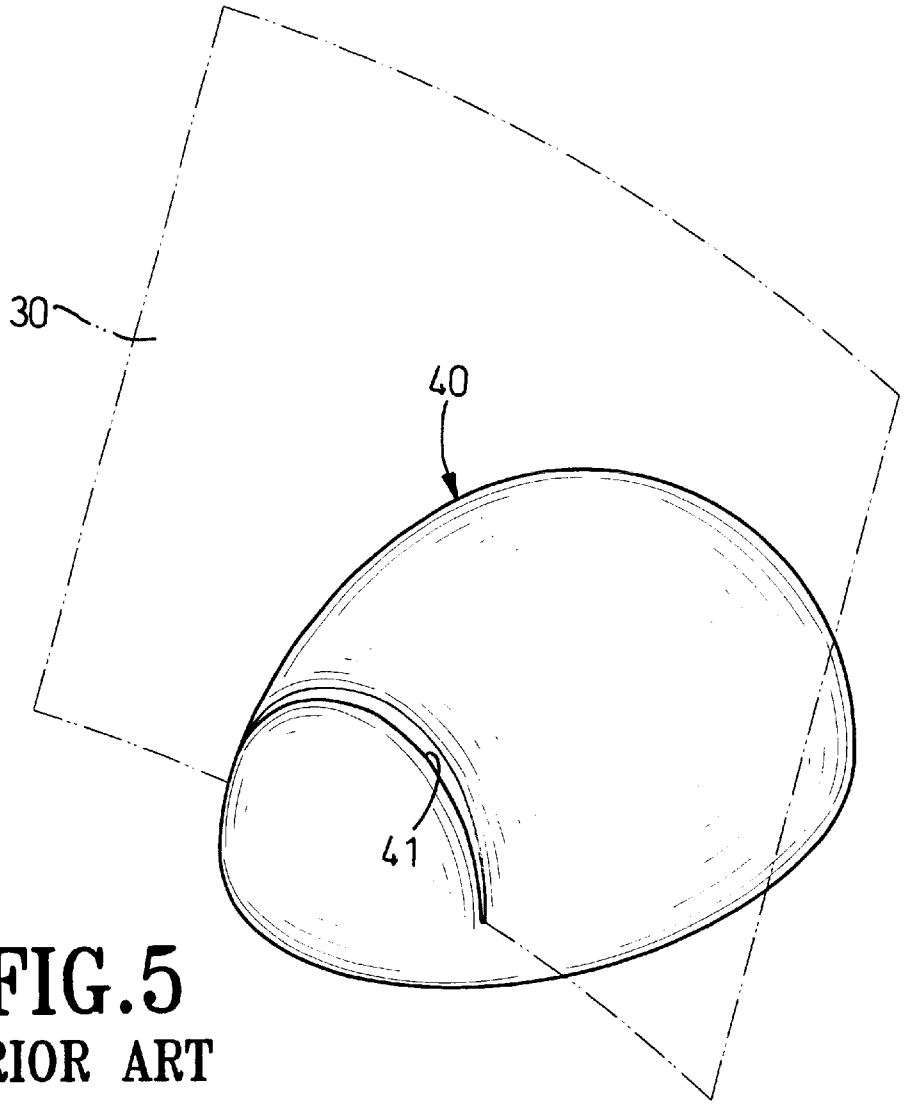
FIG.5 PRIOR ART
FIG. 5 is a perspective view of a conventional note holder.

With reference to FIG. 4, the note holder is foldable because the body (20) is pivotally mounted in the base (10). The user turns the body (20) into the inner space from the bottom of the base (10). Similarly, the key (13) is fitted into the other keyhole (29) so the body (20) can be positioned and held in the inner space. The note holder has a smaller size for storage and carrying.

The invention has the following advantages:

1. Foldable capability: The body (20) is pivotally mounted in the base (10), and the base (10) has the inner space to receive the body (20). When the note holder is not in use, the body (20) is turned relative to the base (10) and the inner space holds the body (20). The note holder is smaller than when in use, and it will occupy a smaller space in storage and be more convenient to carry it.

2. Good Use:

The note holder in accordance with the present invention has several fins (24,25,26) in the slot (23), which bend and securely hold notes (30) inserted into the slot (23). The user does not have to worry about the note (30) sliding or being blown out of the slot (23).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A note holder comprising:

a U-shaped base having two ends, a top, a bottom and an inside surface, with the inside surface being around an inner space located between the top and bottom; and a body having a center and first and second wings extending from the center, with both the first and second wings having an inside surface facing each other, with a slot formed between the inside surfaces of the first wing and the second wing for receiving a note, with the center of the body being pivotably mounted about an axis between the two ends of the U-shaped base for movement of the body between a nonuse position and a use position, with the body opposite to the axis in the nonuse position being received in the inner space of the U-shaped base and the slot extending parallel to the inner space of the U-shaped base, and with the body opposite to the axis located outside of the inner space and the slot extending at a display angle to the inner space of the U-shape base in the use position.

2. The note holder as claimed in claim 1, wherein a lip is formed on the inside surface at the top of the base, with the lip abutting with the first wing when the body is in the nonuse position to prevent pivotal movement therebeyond.

3. The note holder as claimed in claim 2 wherein the first and second wings are fixed relative to each other, wherein a primary fin extends on the inside surface of the first wing perpendicular to the axis, with the primary fin having two sides extending perpendicular to the axis, and wherein an opposing fin is fixed on the inside surface of the second wing at a side corresponding to each of the two sides of the primary fin respectively.

4. The note holder as claimed in claim 3, wherein two auxiliary fins are formed on the inside surface of the first wing corresponding to the opposing fins of the second wing.

5. The note holder as claimed in claim 4, wherein a recess is formed on the inside surface of the second wing between the two opposing fins.

6. The note holder as claimed in claim 5 wherein the center of the body is pivotably mounted by two pivot pins formed on one of the inside surface near the ends of the base respectively and on opposite sides of the center of the body end and by two pivot holes formed in the other of the inside surface near the ends of the base respectively and of the opposite sides of the center of the body, with each pivot hole corresponding to a different pivot pin.

7. The note holder as claimed in claim 6 wherein a key is integrally formed with one of the two pivot pins, with the key having an axial extent less than the pivot pin and extending radially from the pivot pin, and wherein two keyways communicate with one of the two pivot holes, with each keyway corresponding to the key, with the two keyways corresponding to the nonuse position and the use position.

8. The note holder as claimed in claim 1, wherein the center of the body is pivotably mounted by two pivot pins formed on one of the inside surface near the ends of the base respectively and on opposite sides of the center of the body end and by two pivot holes formed in the other of the inside surface near the ends of the base respectively and of the opposite sides of the center of the body, with each pivot hole corresponding to a different pivot pin.

9. The note holder as claimed in claim 8 wherein a key is integrally formed with one of the two pivot pins, with the key having an axial extent less than the pivot pin and extending radially from the pivot pin, and wherein two keyways communicate with one of the two pivot holes, with each keyway corresponding to the key, with the two keyways corresponding to the nonuse position and the use position.

10. The note holder as claimed in claim 9 wherein the first and second wings are fixed relative to each other, wherein a primary fin extends on the inside surface of the first wing perpendicular to the axis, with the primary fin having two sides extending perpendicular to the axis, and wherein an opposing fin is fixed on the inside surface of the second wing at a side corresponding to each of the two sides of the primary fin respectively.

11. The note holder as claimed in claim 10, wherein two auxiliary fins are formed on the inside surface of the first wing corresponding to the opposing fins of the second wing.

12. The note holder as claimed in claim 11, wherein a recess is formed on the inside surface of the second wing between the two opposing fins.

13. The note holder as claimed in claim 1 wherein the first and second wings are fixed relative to each other, wherein a primary fin extends on the inside surface of the first wing perpendicular to the axis, with the primary fin having two sides extending perpendicular to the axis, and wherein an opposing fin is fixed on the inside surface of the second wing at a side corresponding to each of the two sides of the primary fin respectively.

14. The note holder as claimed in claim 13, wherein two auxiliary fins are formed on the inside surface of the first wing corresponding to the opposing fins of the second wing.

15. The note holder as claimed in claim 14, wherein a recess is formed on the inside surface of the second wing between the two opposing fins.

16. The note holder as claimed in claim 1 wherein the body is wholly received in the inner space between the top and bottom in the nonuse position.

* * * * *